US008991446B2

(12) United States Patent
Hurley et al.

(10) Patent No.: US 8,991,446 B2
(45) Date of Patent: Mar. 31, 2015

(54) PUMP ASSISTED REFILLING SYSTEM FOR LPG FUEL TANKS

(75) Inventors: Richard W. Hurley, Glen Waverly (AU); Nicholas Carter, Fairfield (AU)

(73) Assignee: GM Global Technology Operations LLC, Detroit, MI (US)

( * ) Notice: Subject to any disclaimer, the term of this patent is extended or adjusted under 35 U.S.C. 154(b) by 1101 days.

(21) Appl. No.: 13/013,941

(22) Filed: Jan. 26, 2011

(65) Prior Publication Data

US 2012/0189462 A1 Jul. 26, 2012

(51) Int. Cl.
*B65B 1/30* (2006.01)
*F17C 5/02* (2006.01)

(52) U.S. Cl.
CPC ..... *F17C 5/02* (2013.01)
USPC ..... 141/197; 137/14

(58) Field of Classification Search
CPC ..... F17C 5/002
USPC ..... 141/5, 192, 197; 137/14
See application file for complete search history.

(56) References Cited

U.S. PATENT DOCUMENTS

| | | | | |
|---|---|---|---|---|
| 4,475,348 | A * | 10/1984 | Remes | 62/50.4 |
| 5,081,977 | A | 1/1992 | Swenson | |
| 5,373,702 | A * | 12/1994 | Kalet et al. | 62/50.2 |
| 5,479,906 | A | 1/1996 | Collie | |
| 5,771,946 | A | 6/1998 | Kooy et al. | |
| RE35,874 | E | 8/1998 | Neeser et al. | |
| 6,354,088 | B1 * | 3/2002 | Emmer et al. | 62/50.1 |
| 6,622,758 | B2 * | 9/2003 | Drube et al. | 141/82 |
| 7,703,445 | B2 | 4/2010 | Haga | |
| 8,459,241 | B2 | 6/2013 | Dixon | |
| 2012/0060935 | A1 | 3/2012 | Carter | |

FOREIGN PATENT DOCUMENTS

| | | |
|---|---|---|
| JP | 6-213400 | 8/1994 |
| KR | 2002-80772 | 10/2002 |
| WO | WO9810186 A1 | 3/1998 |
| WO | WO2008141390 A1 | 11/2008 |

OTHER PUBLICATIONS

"Industrial Microhydraulics" Product Data Sheet for Lee IMH 8 mm Shuttle Valve, 2 pgs., The Lee Company—IMH Group, Westbrook, CT 06498, dated Aug. 2008.

SAE Technical Paper 981388 "The Effects of Fuel Composition, System Design, and Operating Conditions on In-System Vaporization and Hot Start of a Liquid-Phase LPG Injection System" by Barry R. Lutz, et al, dated May 1998.

"Industrial Microhydraulics" Product Data Sheet for 832 Series Side Exit Check Valve, Forward Flow Check Valve, 1 pg., The Lee Company—IMH Group, Westbrook, CT 06498, dated 2009.

"Industrial Microhydraulics" Product Data Sheet for 832 Series Side Exit Check Valve, Reverse Flow Check Valve, 1 pg., The Lee Company—IMH Group, Westbrook, CT 06498, dated 2009.

* cited by examiner

*Primary Examiner* — Jason K Niesz

(57) ABSTRACT

A pump assisted refilling system for LPG and other fuels wherein the fuel storage pressure is at, or close to, the vapor pressure of the fuel. A fuel pump is selectively activated to assist fuel delivery from the refilling fitting to the tank interior responsive to a determined fuel pressure condition of the fuel so that rapid refilling is always assured.

6 Claims, 2 Drawing Sheets

PUMP ASSISTED REFILLING SYSTEM FOR LPG FUEL TANKS

TECHNICAL FIELD

The present invention relates to liquefied petroleum gas (LPG) fuel systems, and more particularly to a pump assisted refilling system for LPG fuel tanks.

BACKGROUND OF THE INVENTION

Motor vehicle designers continually strive to create vehicles which have lower emissions of noxious and greenhouse gases than vehicles currently in use. One means of reducing vehicular emissions is to utilize alternative fuels. Commonly used fuels such as gasoline and diesel fuel, are mixtures of complex hydrocarbons which may also contain unwanted chemicals, such as sulfur. One form of alternative fuel available is LPG. LPG is primarily composed of propane, a three carbon hydrocarbon, and butane, a four carbon hydrocarbon. These hydrocarbons have a lower carbon to hydrogen ratio than gasoline or diesel fuel. Because the carbon to hydrogen ratio is lower, less carbon dioxide is produced in the burning of LPG than in the burning of gasoline or diesel fuel. The longer chain hydrocarbons of gasoline and diesel fuel are much more likely to produce unwanted particulate emissions in the exhaust gas. Relative to LPG, gasoline and diesel fuel do have two advantages, namely: (i) they are both liquids at STP (standard temperature and pressure), whereas under typical ambient operating conditions LPG must be stored in a pressure vessel to be in a liquefied state; and: (ii) gasoline and diesel fuel produce more energy per unit volume of fuel as compared to LPG, even when LPG is in a liquid state. This means that in dealing with LPG fueled vehicles, one must manage the difficulties encountered with temperatures and pressures far from the ambient range.

A key physical factor in the management of LPG fuel conditions is the liquid/gas equilibrium. The ambient conditions will dictate the mixture of LPG vapor and LPG liquid found in the fueling system. Additional measures must be taken to ensure the correct balance of liquid and vapor for the operation of the fuel consumer, as for example the internal combustion engine of a motor vehicle. For example, the ignition system of the engine can be designed to use either a gas phase LPG or a liquid phase LPG. Components may be added to the fueling system to either condense vapor into the liquid state or to ensure that all the liquid state has been evaporated and heated into a gaseous state, depending on which phase of the fuel is required.

FIG. 1 schematically depicts an exemplar prior art LPG fuel system 10 providing fuel to a consumer, for example the engine of a motor vehicle, the system being shown undergoing refilling of the fuel tank via a conventional filler neck.

A pressurized fuel tank (or vessel) 12 holds LPG fuel 14 in a liquid phase 14' and a vapor phase 14". The fuel tank 12 is equipped with a pressure relief valve 15, and may be equipped with a temperature sensor 16 and a pressure sensor 18. The LPG fuel 14 within the fuel tank 12 may be subject to external heat 20 as for example coming from the motor vehicle exhaust system, outside of the fuel tank 12, as well as heat 22 from components within the fuel tank 12, as for example, produced by a fuel pump 24. All of these sources of heat increase the temperature inside the fuel tank 12, thereby increasing the vapor pressure inside the fuel tank.

By way of example, contained within the fuel tank 12 are components that make up a fuel delivery system 26. These components may be simply a filter 28 at a lead end of the fuel line 30, or may be a fuel pumping system 32 connected to the fuel line 30, including, merely by way of example, the filter 28, the fuel pump 24 (typically engaged to boost fuel feed pressure when the pressure inside the fuel tank 12 is below a predetermined level), a check valve 34, a filter 36, and a fuel pressure regulator 38 so that a desired fuel pressure differential across the fuel pump is maintained. External to the fuel tank 12, the fuel line 30 connects with various safety and fuel conditioning components well known in the art (not shown) which are suitable to the particular fuel delivery application that pertains to the fuel consumer 40.

An LPG refilling source or bowser 42 is schematically shown connected by means of a bowser nozzle 44, to a pressure sealed release refilling fitting 46 of the fuel tank filler neck 48. The fuel flow 50 is from the bowser 42 through the refilling fitting 46 and into the interior of the fuel tank 12, wherein an internal fill level valve 52, as for example in the form of a float valve, provides automatic shut-off of the fuel flow when the liquid phase 14' reaches a predetermined level in the fuel tank 12.

For rapid refilling to occur, the fuel pressure of the bowser nozzle 44 should be well in excess of the fuel vapor pressure within the fuel tank 12. As the fuel vapor pressure within the tank approaches the bowser nozzle fuel pressure, the rate of refilling decreases and, if the fuel vapor pressure becomes high enough relative to the bowser nozzle pressure, refilling may become impossible. Impossible to refill, or no-fill situations, in which fuel cannot flow from the bowser nozzle into the fuel tank because of excessive backpressure caused by the fuel vapor pressure within the tank, are highly undesirable. If such a no-fill situation is encountered, then a technique used in the prior art to overcome this problem is to cool the contents of the fuel tank down in order to reduce the vapor pressure inside the fuel tank. Methods of the prior art to do this include pouring cold water over the fuel tank or placing ice or wet rags on the fuel tank. Such methods can be difficult and time-consuming to implement, and may be unacceptable, impractical or unavailable, depending on the circumstances.

Concern over ability to refill the fuel tank is exacerbated for fuels having multiple chemical components of varying volatility. LPG and other fuels which are stored at vapor pressure typically have multiple chemical components, each having differing vapor pressures. Examples of high vapor pressure components which may be present in LPG fuels include: ethane, nitrogen and carbon dioxide; and manufacture or servicing may introduce air (or other contaminant gases such as nitrogen used for leak detection) into the tank, which may not have been completely purged out. The vapor pressure inside the fuel tank is the vapor pressure of the fuel mixture, however the individual chemical components may have a vapor pressure which is higher or lower than the vapor pressure of the mixture. If the vapor pressure of a chemical component is higher than the mixture, then the component will tend to remain in its gaseous phase and the concentration (mole fraction) of that chemical component will be higher in the vapor phase relative to the liquid phase. Conversely, if the vapor pressure of a chemical component is lower than the mixture, then the concentration (mole fraction) of that chemical component will be lower in the vapor phase relative to the liquid phase. The chemical composition of the vapor phase inside the fuel tank will typically be different in relation to the chemical composition of the liquid phase because the vapor phase will contain a higher concentration (mole fraction) of high vapor pressure chemical components relative to the liquid phase. As a result, the rate at which high vapor pressure chemical components can be withdrawn from the fuel tank is less when liquid fuel is extracted as compared to when fuel vapor is extracted. Accordingly, as a fuel tank is emptied, the final vapor pressure will be related to the ratio of the chemical components, and that will depend upon the ratio of the liquid fuel to fuel vapor extracted. If high volatility (high vapor pressure causing) chemical components have been favored to remain in their gaseous phase and therefore 'compress' rather than 'condense' as the pressure inside the fuel tank increases, ability to refill the fuel tank is adversely affected. If the fuel tank pressure approaches the bowser nozzle pressure before the fuel tank can be filled up, then it will not be possible to fully refill (refuel) the fuel tank. Thus, if high vapor pressure components are allowed to accumulate inside a fuel tank, then the rate of refilling will be slow, or refilling may even be prevented (a no-fill situation). This problem is exacerbated for the next refill if during the present refill, a relatively larger quantity of high vapor pressure chemical components are added to the fuel tank than will be removed during operation of the fuel consumer. Therefore, it is desirable to keep the concentration of high vapor pressure chemical components at low levels in the fuel supplied; however, this may impose increased fuel costs, and the desired low levels from the perspective of fuel tank refilling, may not always be met in practice.

In the case of fuels which are stored at, or near their vapor pressure, the pressure in both the bowser supply tank and the fuel tank being refilled (refueled) will be close to the vapor pressure of the fuel, and both tanks will contain a mixture of liquid fuel and fuel vapor.

Variables which can affect the likelihood of a no-fill situation include: 1) the pressure differential across the bowser; 2) the height of the liquid fuel level in the bowser supply tank, relative to that of the fuel tank being refilled (for example, the bowser supply tank may be located underground, whereas the fuel tank being refilled is typically located above ground); 3) the chemical composition of the fuel in the bowser supply tank (fuel vapor pressure varies with chemical composition and the feed pressure at the bowser nozzle, may be reduced if the bowser supply tank contains low vapor pressure fuel); 4) the temperature of the fuel in the bowser supply tank (a lower fuel temperature will reduce the vapor pressure in the bowser tank and hence the feed pressure at the bowser nozzle; 5) the chemical composition of fuel in the fuel tank being refilled (fuel vapor pressure varies with chemical composition and the backpressure at the bowser nozzle to fuel tank interface will increase if the fuel tank being refueled contains high vapor pressure fuel); and, 6) the temperature of fuel in the fuel tank being refilled (a high fuel temperature will increase the backpressure at the bowser nozzle to fuel tank interface).

Factors which can affect this sixth variable (the temperature of the fuel in the fuel tank being refilled) include: 1) ambient temperature (higher ambient temperature tends toward higher fuel temperature), 2) proximity of the exhaust system to the fuel tank (reduced separation typically results in increased heat transfer to the fuel tank), 3) engine load (a higher engine load can result in increased heat transfer from the exhaust system to the fuel tank, 4) airflow over the fuel tank (increased airflow results in better convective cooling), and 5) engine run time (a longer time may translate to more heat transfer to the fuel tank.

FIG. 2 is a graph 60 of probability 62 (as an increasing percent) versus pressure 64 (in bar), which exemplifies how refilling (or refueling) of an LPG fuel tank may be affected by the vapor pressure within the fuel tank. Distribution curve 66 represents a hypothetical probability distribution of bowser nozzle pressure of a bowser (or fuel supply station), and distribution curve 68 represents a hypothetical probability distribution of the fuel vapor pressure within an LPG fuel tank under prior art operational conditions, both immediately prior to commencement of refilling, and wherein point 70 represents a hypothetical maximum safe tank pressure. Both distribution curves 66, 68 are affected by factors such as ambient temperature and fuel chemical composition, which can vary from fill-to-fill and from market-to-market. By way of example only, to facilitate fuel flow from the bowser nozzle into the fuel tank, the bowser nozzle pressure should be greater than preferably about 5 bar or more over that of the fuel vapor pressure inside the fuel tank in order to facilitate rapid refilling of the fuel tank in a filling station environment.

Accordingly, what remains needed in the art of LPG fuel systems, is to somehow selectively modify the pressure differential between the bowser feed pressure of the fuel entering the fuel storage tank and the vapor pressure within the fuel tank so that rapid refilling is always assured.

SUMMARY OF THE INVENTION

The present invention is a pump assisted refilling system for LPG and other fuels wherein the fuel storage pressure is at, or close to, the vapor pressure of the fuel. The present invention provides selective modification of the pressure differential as between the bowser feed pressure of the fuel entering the fuel storage tank and the vapor pressure within the fuel tank so as to assure rapid refilling will always occur.

The present invention consists of a refilling fuel pump disposed, preferably, in the fuel tank filler neck, wherein the refilling fuel pump is activated (that is, it is switched on) whenever: a) the sensed pressure differential as between the bowser feed nozzle pressure and the fuel vapor pressure in the fuel tank interior is at or below a predetermined differential pressure, or 2) the fuel tank vapor pressure is at or above a predetermined fuel tank vapor pressure, collectively referred to herein as a predetermined fuel pressure assistance condition, wherein the activation of the refilling fuel pump assists delivery of the fuel from the bowser to the interior of the fuel tank. For differential pressures above the predetermined differential pressure, or for fuel tank vapor pressure below the predetermined fuel tank vapor pressure, collectively referred to herein as a predetermined fuel pressure non-assistance condition, the fuel delivery rate is deemed to be acceptably fast, so the refilling fuel pump is not activated (that is, it is switched off).

The implementation of the refilling fuel pump at the fuel tank filler neck can have differing configurations.

In one exemplar configuration, the operational states of a three-way solenoid valve are responsive to a controller having fuel pressure data input and appropriate programming, wherein in a first state of the valve, fuel delivered from the bowser is piped into the refilling fitting and then through a main conduit directly to the interior of the fuel tank; and in a second state of the valve, fuel delivered from the bowser is diverted, after the refilling fitting, to an auxiliary conduit interfaced with the refilling fuel pump, which is activated to thereby pump fuel from the refilling fitting into the fuel tank interior.

In another exemplar configuration, the operational states of a shuttle or check valve are responsive to directly sensed fuel pressure, wherein in a first state of the valve, fuel delivered from the bowser is piped into the refilling fitting and then through a main conduit directly to the interior of the fuel tank; and in a second state of the valve, fuel delivered from the bowser is diverted, after the refilling fitting, to an auxiliary conduit interfaced with the refilling fuel pump, which is activated to thereby pump fuel from the refilling fitting into the fuel tank interior.

In yet another exemplar configuration, fuel delivered from the bowser is piped into the refilling fitting and then through a conduit directly to the interior of the fuel tank, wherein the conduit is interfaced with the refilling fuel pump. In response to sensed fuel pressure, the refilling fuel pump is selectively activated to thereby pump fuel from the refilling fitting into the fuel tank interior.

Once the level of liquid fuel inside the tank reaches a predetermined level, the fill level valve will terminate the filling process in the normal, conventional manner.

Further according the methodology of the present invention, the liquid fuel entering the LPG fuel storage tank from the bowser will provide fuel tank cooling as a result of the fuel expanding as it passes into the LPG fuel storage tank, whereby in the event that the refilling fuel pump has been activated because the sensed pressure is the predetermined fuel pressure assistance condition, this cooling will encourage its deactivation once the sensed pressure becomes the predetermined fuel pressure non-assistance condition.

Accordingly, it is an object of the present invention to provide a pump assisted refilling system for LPG fuel tanks which provides selective modification of the pressure differential as between the bowser feed pressure of the fuel entering the fuel storage tank and the vapor pressure within the fuel tank so as to assure rapid refilling will always occur.

This and additional objects, features and advantages of the present invention will become clearer from the following specification of a preferred embodiment.

DESCRIPTION OF THE PREFERRED EMBODIMENT

Figure 1:
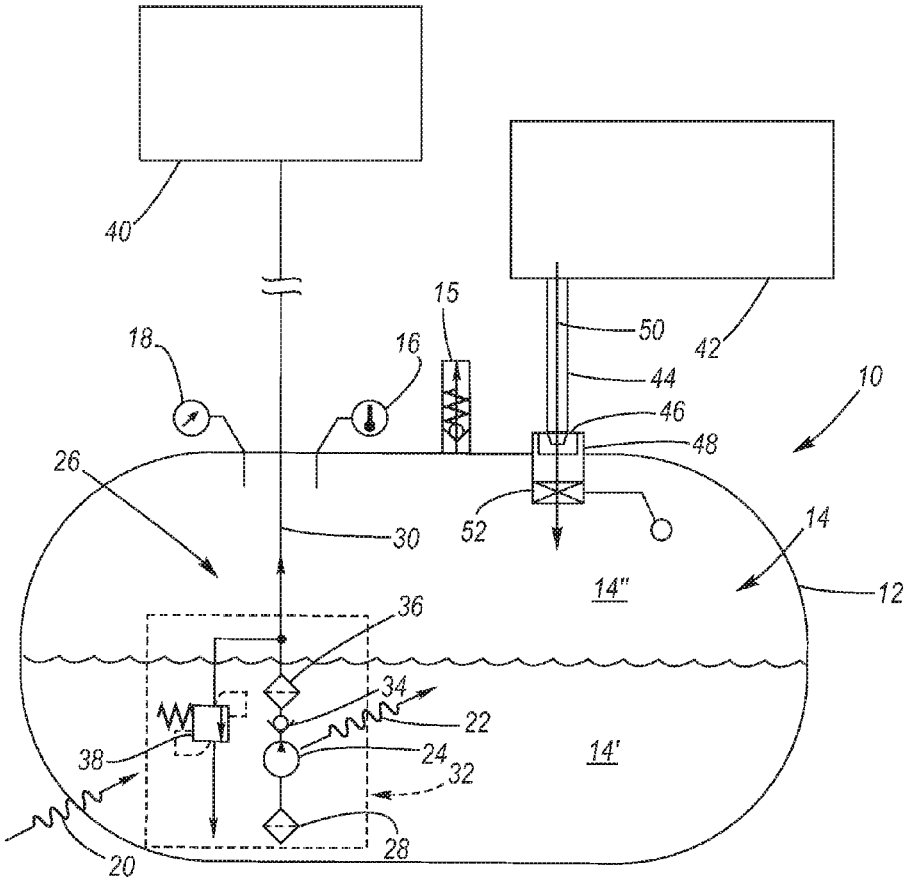
Prior Art Fig. 1
FIG. 1 is a schematic diagram of an exemplar prior art LPG fuel system, shown in refilling mode, and showing in particular a conventional fuel tank filler neck connected to the bowser nozzle of a bowser.

Referring now to the Drawings, FIGS. 3 through 6 depict aspects for implementing a pump assisted fuel tank refilling system 100 according to the present invention.

The pump assisted fuel tank refueling system 100 can be implemented with any fuel tank having fuel contents generally in both the liquid and vapor phase, wherein the fuel storage pressure is at, or close to, the vapor pressure of the fuel. Fuels which may be stored this way include, but are not limited to: propane, butane, liquefied petroleum gas (LPG), and dimethyl ether. Application of the present invention is intended to include all such fuel systems which store fuel at, or close to, the vapor pressure of the fuel, and the exemplar LPG fuel systems presented herein are merely for purposes of illustration. Thus, any reference herein to 'LPG' should be widely taken to mean any fuel stored at or near its vapor pressure' and not as restricting the scope of the present invention to LPG fuel systems. Similarly, reference herein to motor vehicle fuel systems should not be taken as restricting the scope of the invention thereto, as the present invention applies to any gaseous phase fuel system application utilizing a fuel consumer which may or may not be an internal combustion engine.

Figure 3:
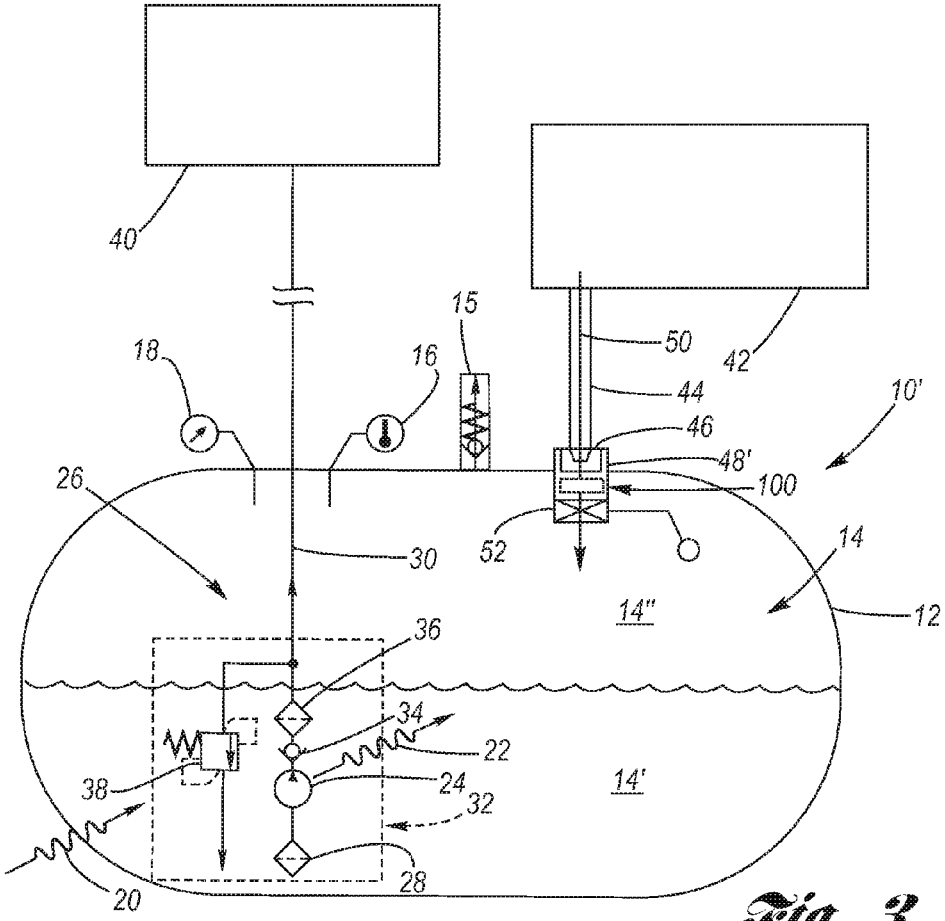
FIG. 3 is a schematic diagram of an LPG fuel system similar to that of FIG. 1, but now showing in particular a fuel tank filler neck equipped with a pump assisted refilling system according to the present invention.

By way merely of exemplification, FIG. 3 schematically depicts a fuel system as in FIG. 1 with like functioning parts having like reference numerals, now including the pump assisted fuel tank refilling system 100 of the present invention, which is disposed, preferably, at the fuel tank filler neck 48'. An LPG refilling source or bowser 42 is schematically shown connected by means of a bowser nozzle 44, to a pressure sealed release refilling fitting 46 of the fuel tank filler neck 48'. The fuel flow 50 is from the bowser 42 to the refilling fitting 46, through the pump assisted fuel tank refilling system 100 and then into the interior of the fuel tank 12, wherein an internal fill level valve 52, as for example in the form of a float valve, provides automatic shut-off of the fuel flow when the liquid phase 14' reaches a predetermined level in the fuel tank 12.

The pump assisted fuel tank refilling system 100 includes a refilling fuel pump 102 (see FIGS. 4 through 6), wherein the refilling fuel pump is activated (that is, it is switched on) whenever: a) the sensed pressure differential as between the bowser feed nozzle pressure and the fuel vapor pressure in the interior of the fuel tank 12 is at or below a predetermined differential pressure, or 2) the fuel vapor pressure in the interior of the fuel tank 12 is at or above a predetermined fuel tank vapor pressure, collectively referred to herein as a predetermined fuel pressure assistance condition, wherein the activation of the refilling fuel pump assists delivery of the fuel from the bowser 42 (at the refilling fitting 46) to the interior of the fuel tank 12. For differential pressures above the predetermined differential pressure, or for fuel tank vapor pressure below the predetermined fuel tank vapor pressure, collectively referred to herein as being a predetermined fuel pressure non-assistance condition, the fuel delivery rate is deemed to be acceptably fast, so the refilling fuel pump 102 is not activated (that is, it is switched off). Once the level of liquid fuel 14' inside the fuel 12 tank reaches a predetermined level, the fill level valve 52, will terminate the filling process in the normal, conventional manner.

Figure 2:
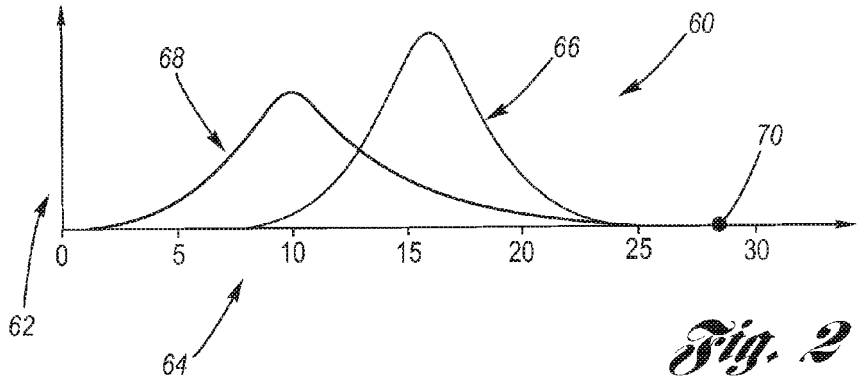
FIG. 2 depicts graphically the probability distribution of exemplar bowser LPG fuel delivery pressure and of LPG fuel vapor pressure inside the fuel tank.

By way merely of exemplification and not limitation the following pressure threshold examples are provided. Where a predetermined differential pressure is used, then the predetermined differential pressure may be about 5 bar, wherein for differential pressures in which the bowser fuel delivery pressure at the refilling fitting is less than the about 5 bar above the fuel vapor pressure within the fuel tank, then the predetermined fuel pressure assistance condition is present and the refilling fuel pump is activated; otherwise, for bowser fuel delivery pressure at the refilling fitting greater than the about 5 bar above the fuel vapor pressure within the fuel tank, then the predetermined fuel pressure non-assistance condition is present (that is, the predetermined fuel pressure assistance condition is absent) and the refilling fuel pump is not activated. Where a predetermined fuel vapor pressure within the fuel tank is used, then predetermined fuel vapor pressure may be set at about 8 bar, as per the exemplar bowser pressure probabilities exemplified at FIG. 2, wherein for fuel vapor pressures within the fuel tank above about 8 bar, then the predetermined fuel pressure assistance condition is present and the refilling fuel pump is activated; otherwise, for vapor pressures within the fuel tank below the about 8 bar, then the predetermined fuel pressure non-assistance condition is present (that is, the predetermined fuel pressure assistance condition is absent) and the refilling fuel pump is not activated. The selected pressure threshold value for determining the presence and absence of the predetermined fuel pressure assistance condition would be determined by modeling or empirical testing as per the particular application.

According the methodology of the present invention, the fuel flow 50 of the liquid fuel entering the LPG fuel storage tank 12 from the bowser 42 will provide fuel tank cooling as a result of the fuel expanding as it passes into the LPG fuel storage tank, whereby in the event that the refilling fuel pump 102 has been activated because the sensed pressure is the predetermined fuel pressure assistance condition, this cooling will encourage deactivation of the refilling fuel pump once the sensed pressure becomes the predetermined fuel pressure non-assistance condition.

Figure 4:
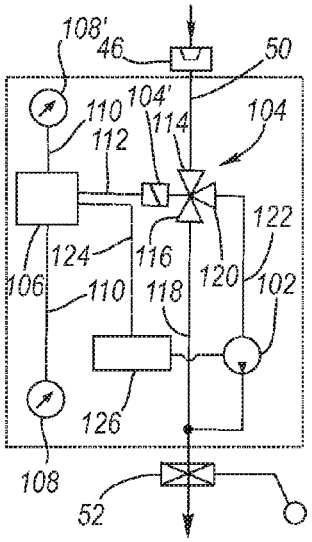
FIG. 4 is a detailed schematic diagram of a first exemplar pump assisted refilling system according to the present invention.
Figure 5:
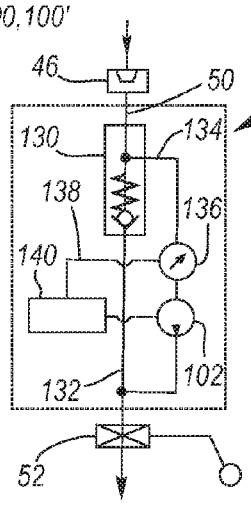
FIG. 5 is a detailed schematic diagram of a second exemplar pump assisted refilling system according to the present invention.
Figure 6:
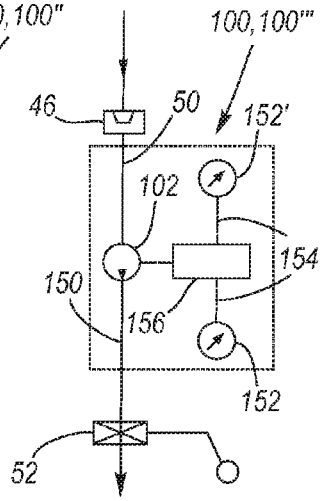
FIG. 6 is a detailed schematic diagram of a third exemplar pump assisted refilling system according to the present invention.

It will occur to those skilled in the art that the pump assisted fuel tank refilling system 100 can be implemented in a number of ways; accordingly, FIGS. 4 through 6 depict exemplar implementations for instructive purposes to those skilled in the art.

FIG. 4 depicts a first implementation 100' of the pump assisted fuel tank refilling system 100, which includes a three-way solenoid valve 104. The operational states of a three-way solenoid valve 104 are responsive to a controller 106 having a fuel pressure data input (from pressure sensor 108 sensing fuel vapor pressure within the fuel tank, and optionally from pressure sensor 108' sensing fuel vapor pressure at the refilling fitting 46, via data line(s) 110. In a first state of the three-way solenoid valve 104 responsive to the sensed pressure and signal sent via data line 112 from the controller 106 to the solenoid 104' of the three-way solenoid valve, fuel flow 50 delivered from the bowser 42 (see FIG. 3) enters the refilling fitting 46, passes into an inlet 114 and exits at a first outlet 116, thereupon being piped through a main conduit 118 and past the fill level valve 52 into the interior of the fuel tank 12. In a second state of the three-way solenoid valve 104 responsive to the sensed fuel pressure and signal sent via the data line 112 from the controller 106 to the solenoid 104' of the three-way solenoid valve, fuel flow 50 delivered from the bowser 42 (see FIG. 3), enters the refilling fitting 46, passes into the inlet 110 and exits at a second outlet 120, thereupon being piped through an auxiliary conduit 122, through the refilling fuel pump 102, past the fill level valve 52 into the interior of the fuel tank 12, wherein the refilling fuel pump is activated via data line 124 and the refilling fuel pump activation circuit 126 so as to pump fuel from the bowser into the fuel tank interior. The first state of the three-way solenoid valve 104 (with deactivation of the refilling fuel pump) is provided by the controller 106 whenever the sensed pressure is the predetermined fuel pressure non-assistance condition; the second state of the three-way solenoid valve with activation of the refilling fuel pump 102 is provided by the controller whenever the sensed pressure is the predetermined fuel pressure assistance condition.

FIG. 5 depicts a second implementation 100" of the pump assisted fuel tank refilling system 100, which includes a shuttle or check valve 130. The operational states of the valve 130 are responsive to directly sensed fuel pressure, wherein in one state of the valve 130, fuel flow 50 delivered from the bowser to the refilling fitting 46, piped through a main conduit 132 and past the fill level valve 52 into the interior of the fuel tank 12. In a second of the valve 130 responsive to the directly sensed fuel pressure, fuel flow 50 delivered from the bowser 42 (see FIG. 3) to the refilling fitting 46, then piped through an auxiliary conduit 134, through the refilling fuel pump 102, and then past the fill level valve 52 into the interior of the fuel tank 12, wherein the refilling fuel pump is activated so as to pump fuel from the bowser into the fuel tank interior, wherein fuel pressure is sensed 136 and, via data line 138, provides a signal to the refilling fuel pump activation circuit 140 to activate the refilling fuel pump 102. The first state of the valve 130 (with deactivation of the refilling fuel pump) is provided automatically whenever the sensed pressure is the predetermined fuel pressure non-assistance condition; the second state of the valve with activation of the refilling fuel pump 102 is provided automatically whenever the sensed pressure is the predetermined fuel pressure assistance condition.

FIG. 6 depicts a third implementation 100'" of the pump assisted fuel tank refilling system 100, wherein the refilling fuel pump 102 is disposed in a conduit 150, free of valving, wherein the fuel flow 50 from the bowser 42 (see FIG. 3) goes into the refilling fitting 46, through the refilling fuel pump, past the fill level valve 52 into the interior of the fuel tank 12. Fuel pressure data input (from pressure sensor 152 sensing fuel vapor pressure within the fuel tank, and optionally from pressure sensor 152' sensing fuel vapor pressure at the bowser nozzle 44 (See FIG. 3), via data line(s) 154, deliver a signal to the refilling fuel pump activation circuit 156 to activate the refilling fuel pump 102. The refilling fuel pump 102 is deactivated whenever the sensed pressure is the predetermined fuel pressure non-assistance condition; the refilling fuel pump 102 is activated whenever the sensed pressure is the predetermined fuel pressure assistance condition.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A pump assisted refilling system for a fuel tank holding a fuel at or near its vapor pressure, said refilling system comprising:

a fuel tank having a tank interior;

a refilling fitting connected to said fuel tank; and a refilling fuel pump connected with said fuel tank, said refilling fuel pump being interposed said refueling fitting and said tank interior;

wherein during refilling of said fuel tank via delivery of fuel into said refilling fitting, said refilling fuel pump is activated to assist fuel delivery from said refilling fitting into said tank interior if a predetermined fuel pressure assistance condition is present.

2. The refilling system of claim 1, wherein said fuel pressure assistance condition comprises fuel vapor pressure of fuel disposed within said tank interior being above a predetermined vapor pressure.

3. The refilling system of claim 1, wherein said fuel pressure assistance condition comprises a difference between a pressure of fuel delivered to said refilling fitting and vapor pressure of fuel disposed in said tank interior being less than a predetermined pressure difference.

4. The refilling system of claim 1, further comprising:

a main conduit;

an auxiliary conduit, said refilling fuel pump being fluidically connected with said auxiliary conduit; and a valve connected with main and auxiliary conduits, said valve being selectable between a first state and a second state;

wherein in said first state of said valve, the delivery of fuel from said refilling fitting to said tank interior is conducted along said main conduit, said first state being selected if the predetermined fuel pressure assistance condition is absent; and wherein in said second state of said valve, the delivery of fuel from said refilling fitting to said tank interior is conducted along said auxiliary conduit, said second state being selected if the predetermined fuel pressure assistance condition is present.

5. The refilling system of claim 4, wherein said predetermined fuel pressure assistance condition comprises fuel vapor pressure of fuel disposed within said tank interior being above a predetermined vapor pressure.

6. The refilling system of claim 4, wherein said predetermined fuel pressure assistance condition comprises a difference between a pressure of fuel delivered to said refilling fitting and vapor pressure of fuel disposed in said tank interior being less than a predetermined pressure difference.

* * * * *